US006080042A

United States Patent [19]

McGregor et al.

[11] Patent Number: 6,080,042

[45] Date of Patent: Jun. 27, 2000

[54] FLATNESS AND THROUGHPUT OF SINGLE SIDE POLISHING OF WAFERS

[75] Inventors: Anderson D. McGregor, Mena, Ark.; Thomas G. Digges, Jr., Fredericksburg, Va.

[73] Assignee: Virginia Semiconductor, Inc., Fredericksburg, Va.

[21] Appl. No.: 08/961,815

[22] Filed: Oct. 31, 1997

[51] Int. Cl.[7] ..... B24B 1/00

[52] U.S. Cl. ..... 451/41; 451/291

[58] Field of Search ..... 451/41, 291, 268, 451/269

[56] References Cited

U.S. PATENT DOCUMENTS

| | | | |
|---|---|---|---|
| 3,813,828 | 6/1974 | Bennett | 451/291 |
| 5,191,738 | 3/1993 | Nakazato et al. . | |
| 5,245,790 | 9/1993 | Jerbic . | |
| 5,314,843 | 5/1994 | Yu et al. . | |
| 5,320,706 | 6/1994 | Blackwell . | |
| 5,352,625 | 10/1994 | Hoshi . | |
| 5,362,669 | 11/1994 | Boyd et al. . | |
| 5,377,451 | 1/1995 | Leoni et al. . | |
| 5,421,769 | 6/1995 | Schultz et al. . | |
| 5,424,224 | 6/1995 | Allen et al. . | |
| 5,429,711 | 7/1995 | Watanabe et al. . | |
| 5,486,129 | 1/1996 | Sandhu et al. . | |
| 5,494,857 | 2/1996 | Cooperman et al. . | |
| 5,697,832 | 12/1997 | Greenlaw | 451/291 |
| 5,782,678 | 7/1998 | Cesna et al. | 451/291 |
| 5,897,425 | 4/1999 | Fisher, Jr. et al. | 451/41 |

FOREIGN PATENT DOCUMENTS

| | | | |
|---|---|---|---|
| 000481410 | 12/1975 | U.S.S.R. | 451/268 |
| 001592498 | 6/1981 | United Kingdom | 451/291 |

OTHER PUBLICATIONS

Cawley, Measuring Crystal Plate Thickness in a Lapping Operation, Western Electric, pp. 7–8, Jul. 1981.

Nordyke, Disk Substrate Polisher, IBM Technical Disclosure Bulletin, vol. 26, pp. 1652–1654, Aug. 1983.

Web Page for Zygo, http://www.zygo.com/semicon/semicon.htm, entitled Semiconductor Manufacturing, 3pgs., Sep 11, 1996.

*Primary Examiner*—David A. Scherbel
*Assistant Examiner*—Daniel G. Shanley
*Attorney, Agent, or Firm*—Fish & Richardson P.C.

[57] ABSTRACT

A wafer polishing apparatus includes one or more wafer carriers each containing one or more wafers mounted on both sides of the carrier. Upper and lower turntables having upper and lower polishing surfaces, rotate to polish the wafers attached to the carriers. Hence, wafers on the top of the carriers, and wafers on the bottom of the carriers are polished simultaneously. This configuration increases throughput; also, thermal deformations in the wafers are reduced, thus improving flatness.

15 Claims, 5 Drawing Sheets

FLATNESS AND THROUGHPUT OF SINGLE SIDE POLISHING OF WAFERS

FIELD OF THE INVENTION

The present invention defines an improved system and method for polishing semiconductor wafers. More specifically, the present invention defines a semiconductor wafer polishing apparatus that provides improved wafer throughput and flatness.

BACKGROUND

Integrated circuits fabrication places many integrated circuits simultaneously on a single semiconductor wafer. The wafer is then subjected to a process in which individual integrated circuits are seperated from the wafer. At certain stages of fabrication, it is often necessary to polish a surface of the semiconductor wafer.

Semiconductor wafers are often polished to remove high topography surface defects such as crystal lattice damage, scratches, roughness or embedded particles of dirt or dust. This polishing process is often referred to as mechanical planarization (MP). Manufacturing high quality and reliability semiconductor devices usually requires high quality planarization. This process is usually performed during the formation of various devices and integrated circuits on the wafer.

In general, the polishing process involves holding and rotating a thin flat wafer of semiconductor material against a polishing surface under controlled pressure and temperature.

The polishing process may also involve the introduction of a chemical slurry to facilitate higher removal rates and selectivity between films of the semiconductor surface. This chemical-induced polishing process is often referred to as chemical mechanical planarization (CMP).

FIGS. 1 and 2 show the main components of a conventional polishing apparatus used to polish one face of a semiconductor wafer. A plurality of semiconductor wafers 10 are bonded to the underside surface of a carrier or plate 12 made of glass or other material. First the semiconductor wafers 10 are processed with conventional processing techniques such as lapping, beveling and etching. These wafers are subsequently affixed to the carrier. A material such as wax is typically used so that the wafers can later be removed. A polishing cloth 14 is firmly held on the surface of a turntable 16 which is positioned under the plate 12.

The semiconductor wafers 10 are then brought into contact with the polishing cloth 14 under pressure from the plate 12. At the same time, the turntable 16 rotates to cause the plate 12 to rotate so as to bring the semiconductor wafer 10 into rotating contact with the polishing cloth 14. A polishing slurry including chemical polishing agents is sprayed onto the polishing cloth 14. The polishing slurry typically is a weak alkaline aqueous solution containing colloidal silica as fine abrasive grains which acts to polish the surface of the semiconductor wafer 10.

One problem with this type of polishing process is achieving and maintaining satisfactory flatness. Flatness is important as described above. In addition, photolithographic processes utilized in manufacturing semiconductors need to be in focus during exposure. A high degree of flatness is critical in order to maintain the resolution of the photolithographic lines. These lines can be less than one micron in thickness. The use of stepper lithographic processing heightens the need for a flat wafer surface, particularly on discrete local areas on the surface.

Flatness is quantified, in part, by a total thickness variation measurement (TTV) and site total indicated reading (STIR). TTV is the difference between the maximum and minimum thicknesses of the wafer. STIR is the sum of the maximum positive and negative deviations of the surface in a small area of the wafer from a reference plane, referred to as the focal plane. Total thickness variation in the wafer is a critical indicator of the quality of the polish of the wafer.

Flatness of the polished surfaces of the wafer is not always significantly improved, and may be worsened, by conventional polishing processes. A significant number of wafers will fail to meet flatness and polishing specifications after batch polishing, thus reducing yield in commercial production. Flatness can be worsened by distortions in the wafer. Distortions may be created by the vertical component of the frictional force at the leading edge of a wafer as it encounters an area of particularly high frictional interaction with the polishing pad. A local change in the net vertical force applied to the wafer changes the polishing pressure and the polishing rate of the wafer, thus creating distortions in the polish.

In batch processing, several wafers are rigidly mounted to a single plate, as shown in FIG. 2. Different regions of the polished face may be polished to different degrees because these different regions engage the polishing pad along separate paths. A discontinuity in the pads (e.g., a small lump or an area of glazed slurry) may repeatedly encounter one region of the wafer and not another, causing an imperfection in the polish in one region. Forces and vibrations generated by the interaction of one wafer with the polishing pad are transmitted through the structure of the plate. These forces can undesirably affect the polishing rate and mechanical characteristics of the wafers on the plate. Wafers to be polished by batch processes must be pre-sorted so that all wafers to be mounted at one time on a single plate are of the same thickness to a high degree of accuracy; otherwise, the plate is tilted from the horizontal. This tilting will introduce a non-uniform application of pressure to the wafers on the plate which results in undesirable variations in the polish finish between wafers on the same plate, and throughout the polished surface of each wafer.

The problems of yield associated with batch processing can be alleviated somewhat by single wafer processing, in which each wafer has its own plate. Single wafer processing eliminates the problems of forces transmitted through the pressure plate from one wafer to another. However, single wafer polishing has a very low throughput because only a single wafer per pressure plate is polished at a time. The higher the number of wafers polished simultaneously, the higher the resulting throughput.

Besides these known effects, other factors may also contribute to the unevenness in polishing semiconductor wafers.

SUMMARY

The inventors recognized these problems, and recognized that it would be desirable to provide a higher throughput semiconductor wafer polishing apparatus that generates semiconductor wafers with improved flatness.

The present inventors have discovered a way to provide an increased throughput and improved flatness polishing processes. In accordance with one aspect of the invention, wafers are mounted on both top and bottom sides of a polymeric carrier or plate. Wafers on the top side are polished with a first polishing pad, and wafers on the bottom side are polished with a second polishing pad. This process doubles the throughput of the polishing apparatus.

In accordance with another aspect of the present invention, a plurality of wafer carriers is mounted with a plurality of wafers on both top and bottom sides. The wafer carriers are geared and driven by both sun and planetary gears to induce rotation. Preferably, each carrier rotates about both the axis of the sun gear and its own central axis. An upper polish pad polishes the wafers on the top side of the carrier and a bottom polish pad simultaneously polishes the wafers on the bottom side.

The inventors also discovered an unexpected improvement in flatness that occurs using the invention as compared with prior systems. While the physical mechanisms are not fully understood to account for this improvement, it is clear that better thermal symmetry can be achieved using this technique.

A conventional single-sided polishing process polishes on only one side. That process generates frictional heat on one side of wafers that are mounted on only one side of a carrier. The side of the wafer not being polished is in contact with the cooler carrier and will have a lower temperature than the polished side of the wafer. The inventors postulate that this temperature differential between one side of the wafer and the other may induce bowing or warping in the wafer. Likewise, the carrier itself receives heat from the wafers on one side only. Hence the carriers have temperature gradients that may induce warping of the carrier, and further reduce wafer flatness.

Double sided polishers have other problems from the force being applied to multiple sides of the workpiece at the same tiem.

Using the preferred embodiment wafers are on both sides of the carrier. Hence each wafer and each carrier is heated from both the top and the bottom. The carrier is heated in a more uniform manner. Bowing and warping is reduced. The improved thermal symmetry in both the carrier and the wafers appears to account for the improved wafer flatness demonstrated by the invention.

BRIEF DESCRIPTION OF THE DRAWING

All of these aspects and others will be described with reference to the accompanying drawings wherein.

DESCRIPTION OF THE PREFERRED EMBODIMENTS

Figure 1:
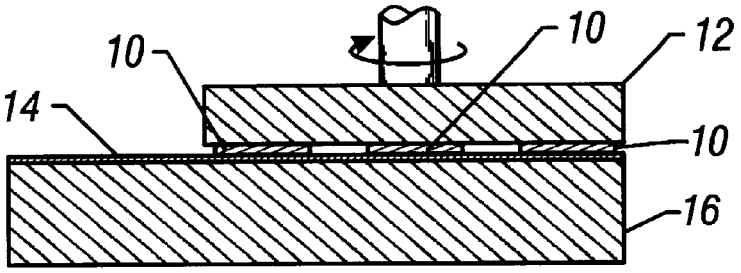
FIG. 1 shows a cross-sectional view of a portion of a single-sided wafer polishing apparatus in accordance with the prior art.
Figure 2:
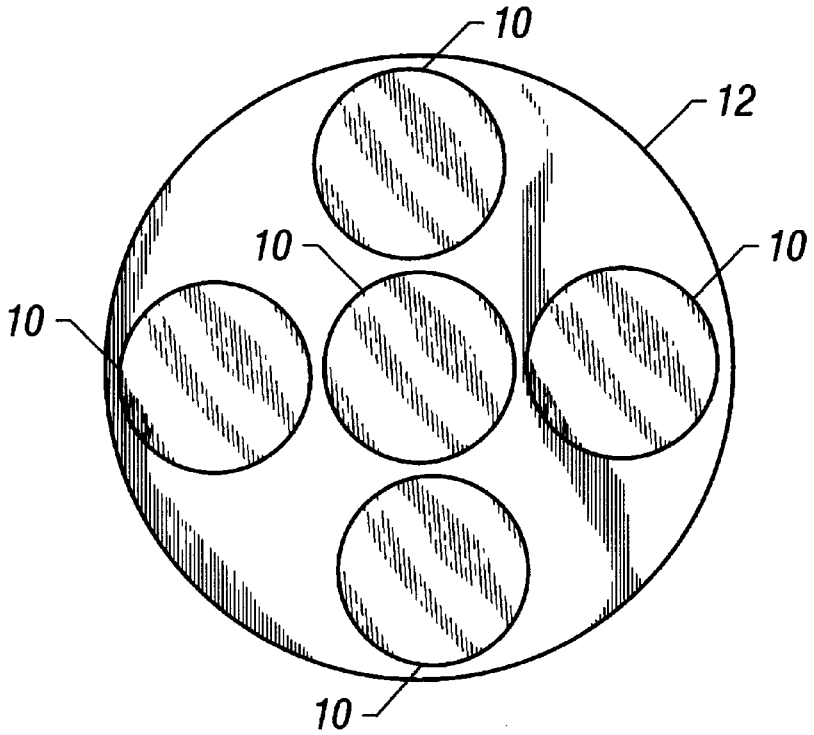
FIG. 2 shows a top view of a carrier of the conventional single-sided wafer polishing apparatus shown in FIG. 1.
Figure 3:
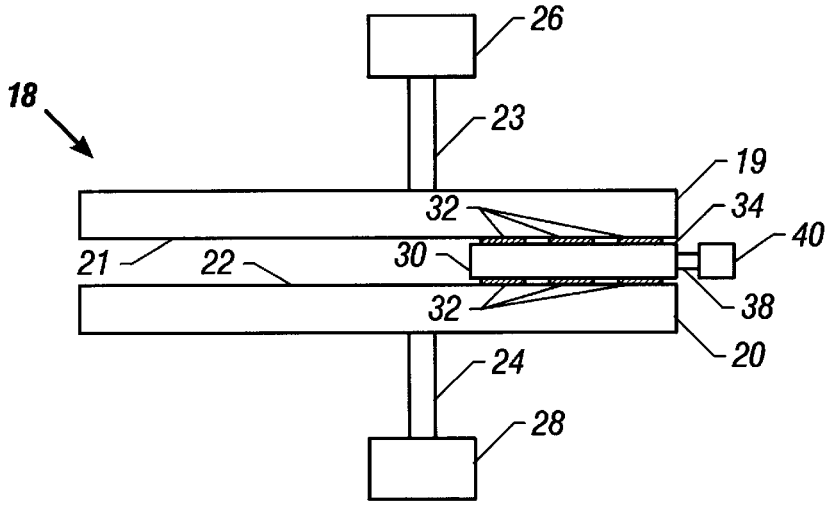
FIG. 3 shows a single sided wafer polishing apparatus in accordance with the present invention.

FIG. 3 shows a high-throughput wafer polisher 18 in accordance with a preferred embodiment of the invention. The wafer polisher 18 includes upper and lower polishing turntables 19 and 20. Polishing cloths 21 and 22 are held firmly on the surfaces of the turntables 19 and 20 forming polishing pads. The turntables are held by shafts 23 and 24 which are rotated by rotating mechanisms 26 and 28, respectively. A semiconductor wafer carrier 30 is disposed between the two polishing pads 21 and 22. A plurality of semiconductor wafers 32 are removably attached to both upper and lower surfaces 34 and 36 of the wafer carrier 30.

The wafer carrier 30 is preferably made of material that has very high flatness on its top and bottom surfaces 34, 36. Glass is the exemplary preferred material. Also, it is desirable to have wafer carrier 30 configured with a thickness and thermal conductivity that conducts heat. This configuration allows heat from frictional forces between the wafers 32 and the upper pad 21 to be transferred downward to the wafers 32 on the lower surface 36 of the carrier 30, and allows heat to be transferred upward from friction with the lower pad 22 to the upper wafers 32. This bilateral heat transference produces improved thermal symmetry, as discussed in more detail below.

The wafer carrier 30 is mounted on a conventional mounting means 38, and may also be rotated by rotating mechanism 40.

Mounting wafers 32 on both sides of the wafer carrier 30 increases the throughput to double that of a conventional polisher with wafers 32 mounted on only a single side. Further increases in throughput can be achieved by using a plurality of carriers 30, each carrying a plurality of wafers 32 on both upper surfaces 34 and lower surfaces 36. The wafers 32 on the upper surface 34 of the carriers 30 are polished by an upper polishing pad 21, and wafers 32 on the lower surface 36 of the carriers 30 are polished by a lower polishing pad 22. Improvements in flatness are also achieved by rotating the carriers 30 while the wafers 32 are being polished. This carrier rotation minimizes the possibility of any wafer 32 continuously being polished by the same, possibly uneven, area of the polishing pads 21 and 22. However, this layout also produces additional advantages which are in no way expectable.

Conventional single sided polishing equipment is not suitable for a plurality of carriers in batch processing because of the need for polishing pads on both the upper and lower sides of the carriers. The inventors have recognized that some double sided wafer polishing apparatuses do have upper and lower polishing pads, though the carrier structure is not suitable for single sided polishing. Hence some of the mechanical features of conventional double sided wafer polishers may be advantageously employed in implementing batch processing in accordance with the present invention.

It should be understood that the present invention is concerned only with improved single sided wafer polishing. When it is necessary to polish a wafer on both sides using the present invention, the wafers may be polished on each side separately.

Figure 4:
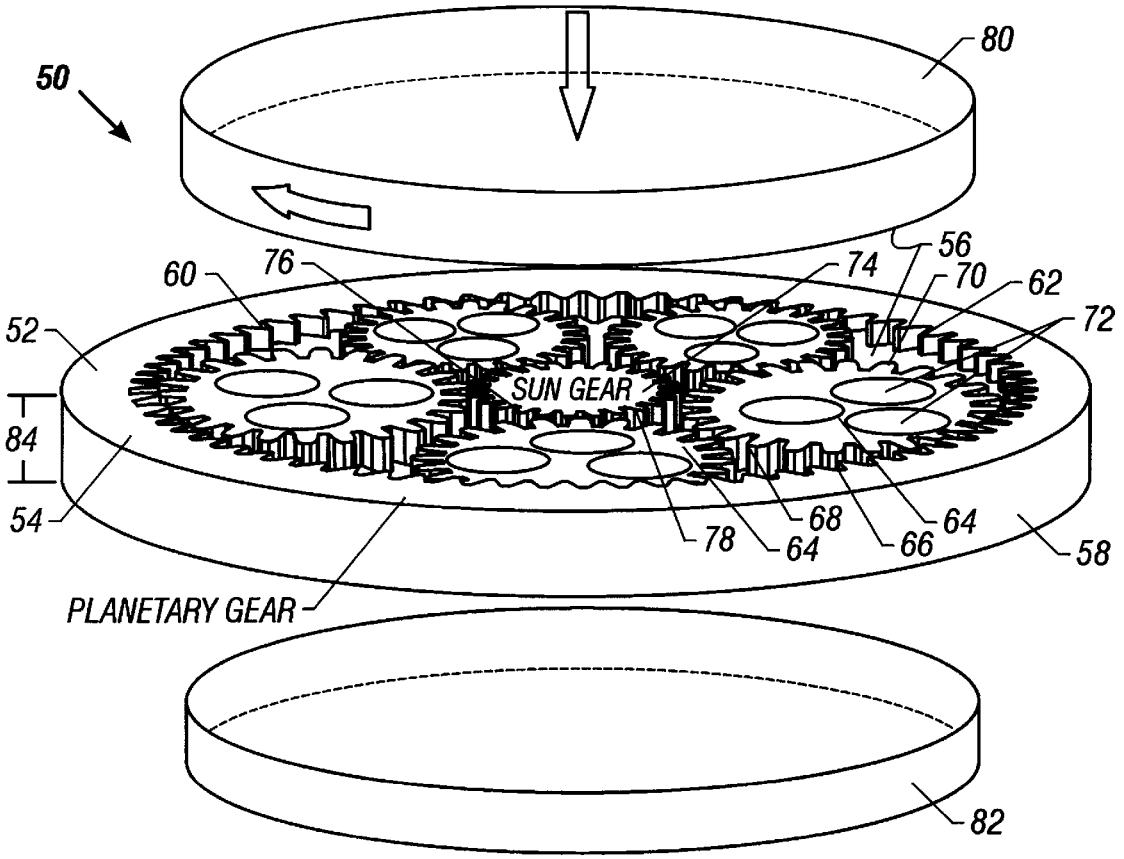
FIG. 4 shows a portion of a conventional double-sided wafer polishing apparatus in accordance with the prior art.

FIG. 4 shows a conventional double-sided wafer polishing apparatus 50 in accordance with the prior art. A planetary gear 52 includes an annular ring 54 having a central opening 56. The planetary gear has a smooth outer surface 58 and a geared inner surface 60 having a plurality of planetary gear teeth 62. A plurality of wafer carriers 64 comprise thin discs each having openings 66 and a geared outer annular surface 68 having a plurality of carrier gear teeth 70. Semiconductor wafers 72 are then inserted into the openings 66 and fastened thereto.

A sun gear 74 having an annular outer surface 76 with a plurality of sun gear teeth 78 is disposed around a central axis of said planetary gear 52. Sun gear teeth 78 engage with carrier teeth 70 in each of the carriers 64 simultaneously. Carrier teeth 70 are also engaged with the planetary gear teeth 62. Upper and lower polishing pads 80 and 82 are disposed above and below the planetary gear 52, respectively.

Figure 5:
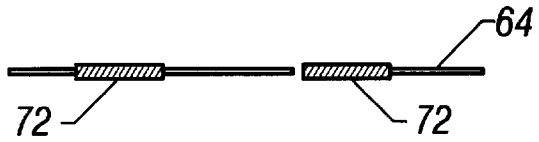
FIG. 5 shows a double-sided polishing carrier with wafers installed used in the double-sided polishing wafer apparatus shown in FIG. 4.

FIG. 5 shows a cross-sectional view of the prior art wafer carriers 64 and wafers 72 mounted thereon, as shown in FIG. 4. The carrier 64 should be thinner than the wafers 72 in order for the polishing pads 80 and 82 to contact the wafers 72.

Returning to FIG. 4, in operation, the double-sided wafer polisher 50 rotates the planetary gear 52 using a rotating motor 84 thereby causing each of the carriers 64 to rotate about their own central axis and also about stationary sun gear 74. Polishing pads 80 and 82 are also rotated by conventional means and brought into contact with the upper and lower sides of the wafers 72, respectively. Wafers 72 are polished on both sides due to movement of the polishing pads 80 and 82, and also by the oscillating/rotating motion of the wafers 72 themselves about sun gear 74.

The throughput of any wafer polisher will depend on the number of wafers polished in any single batch. In conventional polishers this will equal the number of carriers multiplied by the number of wafers per carrier. As discussed above, however, increasing the throughput by simply increasing the number of wafers raises the possibility of decreased flatness as compared to processes that polish a single wafer at a time.

Figure 6:
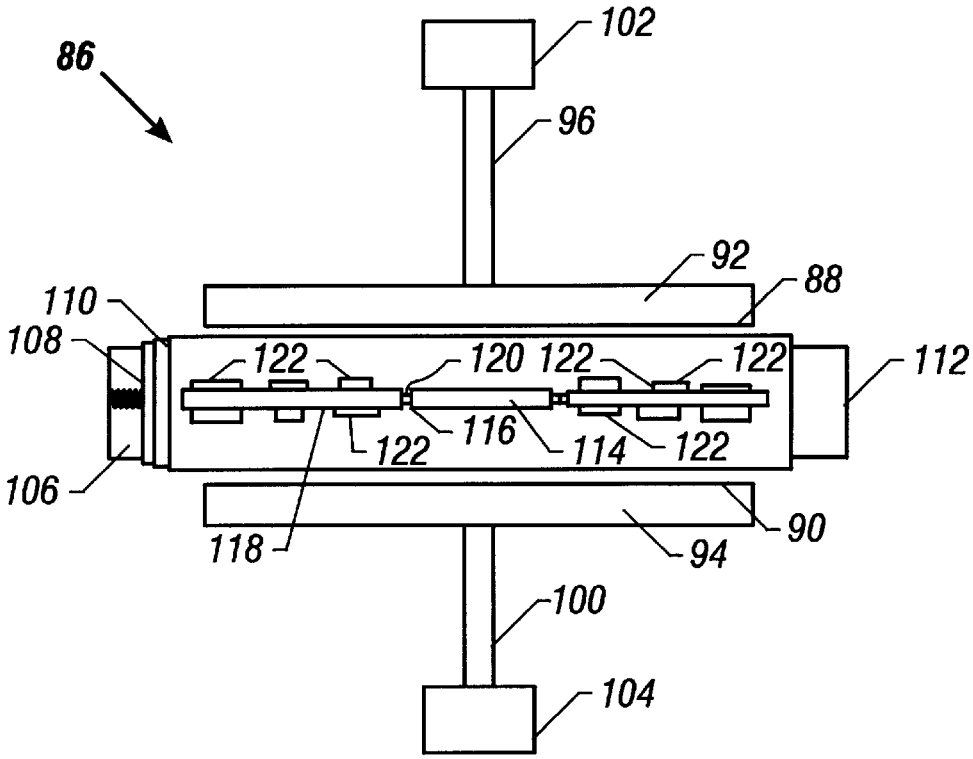
FIG. 6 shows a single-sided wafer polishing apparatus in accordance with the present invention.

FIG. 6 shows a single-sided wafer polishing apparatus 86 in accordance with an embodiment of the present invention. The wafer polisher 86 includes upper and lower polishing pads 88 and 90 which are mounted on upper and lower turntables 92 and 94. The upper and lower turntables 92 and 94 are mounted to upper and lower spindles 96 and 100 which are held by upper and lower drive units 102 and 104, respectively. Rotational and translational motion of the turntables 92 and 94 are induced by the drive units 102 and 104, preferably conventional motor and gear-driven drive units. A planetary gear 106 includes a smooth outer surface 108 and planetary gear teeth 110 along its inner surface. The planetary gear 106 is driven in a circular motion by a planetary gear drive unit 112.

A sun gear 114 is mounted in the center of the planetary gear 106. The sun gear 114 has a series of sun gear teeth 116 on its outer perimeter. Five geared annular wafer carriers 118 are disposed between the sun gear 114 and the planetary gear 106. Each of the wafer carriers 118 has carrier gear teeth 120 on its outer perimeter. The carrier gear teeth 120 engage with both the sun gear teeth 116 and the planetary gear teeth 110.

Figure 7:
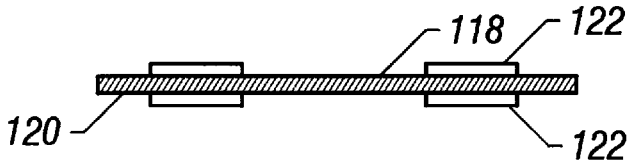
FIG. 7 shows a polishing carrier in accordance with the present invention.

Each wafer carrier 118 holds six wafers 122. Three wafers 122 are mounted on the upper side of the wafer carrier 118, and three wafers 122 are mounted on the bottom side of the wafer carrier 118, as shown in more detail in FIG. 7.

In contrast, the wafer carriers 64 in conventional double-sided semiconductor polishers 50, as shown in FIGS. 4 and 5, must be thinner than the wafer 72 in order to permit double-sided polishing. Such thin wafer carriers 64 present some difficulties due to their thinness, for example, in maintaining sufficient rigidity necessary to maintain wafer flatness during polishing. In the preferred embodiment of the present invention, the thicker wafer carriers 118 shown in FIG. 7 will not have these problems. They do not need to be thinner than the wafers 122 in order for the polishing pads 88 and 90 to be able to polish the wafers 122 from both sides of the carrier 118.

Figure 8:
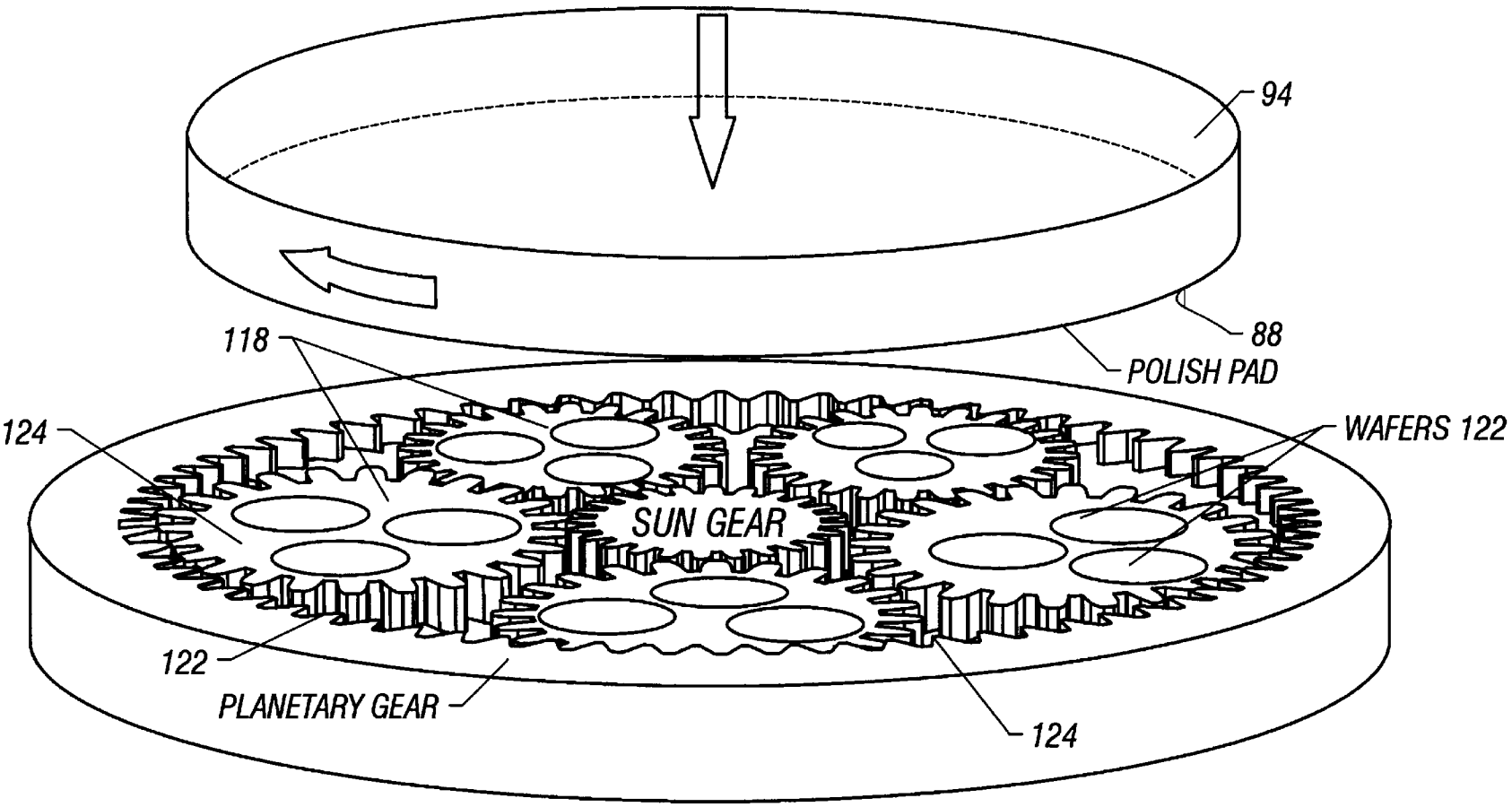
FIG. 8 shows a perspective view of various components of a single-sided wafer polishing apparatus in accordance with the present invention.

FIG. 8 shows an exploded view of a portion of the semiconductor wafer polisher 106 of the present invention. Three wafers 122 are disposed on each side of the carriers 118 and are arranged symmetrically on the surface of the carrier 118. Wafers 122 are mounted on the carriers 118 by first attaching them to a polymeric template 124. The polymeric templates 124 are then affixed to the wafer carriers 118.

In operation, the semiconductor polisher 86 rotates the carriers 118 in a manner similar to that of the double-sided polisher shown in FIG. 4. Of course, the wafer polisher 86 according to this embodiment does not polish two sides of the wafers 122, but instead, polishes a single side of wafers 122 mounted on both the top and the bottom of the carriers 118. In particular, drive unit 112 induces rotation in the planetary gear 106. Drive unit 112 also provides rotatable support for the planetary gear 106. For example, the planetary gear 106 may have outer gear teeth (not shown) and drive unit 112 may rotatably drive these teeth.

The rotating planetary gear 106 engages its planetary gear teeth 110 with the carrier gear teeth 120, thereby rotating each wafer carrier 118 about the stationary sun gear 114. The planetary gear 106 rotates counterclockwise from the perspective of FIG. 8. The upper and lower polishing pads 88 and 90 rotate in a clockwise direction. This countermotion increases the relative velocity between the carriers 118 and the pads 88 and 90, increasing the rate of polishing.

As each carrier 118 rotates about sun gear 114, the carriers 118 will themselves spin about their own central axis. For example, at one point in time a given wafer 122 will be close to the planetary gear 106. After the carrier 118 rotates by 180 degrees, that wafer 122 will be adjacent to the sun gear 114, and farther away from the planetary gear 106. The result is an oscillating motion of individual wafers 122 between outer and inner radial positions on the polishing pads 88 and 90. By having wafers 122 polished by different radial portions of the polishing pads 88 and 90, flatness is further improved, for the reasons discussed above.

A wafer polisher according to the preferred embodiment of the present invention is able to process twice as many wafers in a given batch as would a conventional single sided polisher. For example, the preferred embodiment wafer polisher processes thirty wafers in a single batch as opposed to fifteen wafers in a comparable conventional single-sided polishing process. Fifteen wafers are polished by an upper polishing pad and an additional fifteen wafers are simultaneously polished by a lower polishing pad. Hence twice as many wafers are polished per unit area of the polisher apparatus. The present invention both raises throughput and increases flatness. In a preferred embodiment of the invention, the inventors have accomplished this improvement by using some of the components of a double sided wafer polisher to implement a single sided polisher.

In experimental trials, twenty runs of a wafer polisher in accordance with the preferred embodiment of the present invention were made with 100 millimeter wafers. The wafer carriers were 0.230 inches thick and each held four 4 inch wafers. Flatness of the wafers was compared to historical results with 4 inch wafers using comparable single-sided polishing techniques. The overall result was that flatness (total indicator reading) was improved by a ratio of 7/3.

The applicants do not completely understand why the present invention improves flatness. The inventors postulate that this improvement is likely due, at least in part, to improved thermal symmetry as compared to conventional polishing techniques.

Figure 9A:
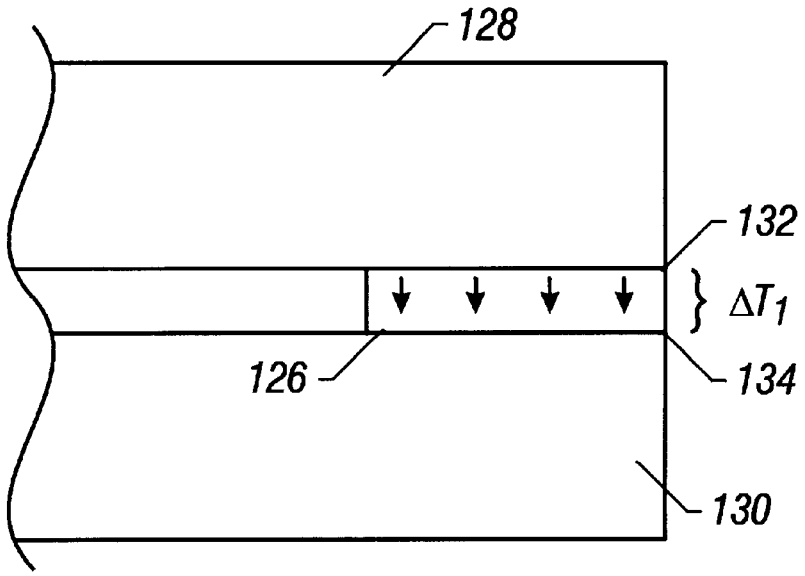
FIGS. 9*a* and 9*b* show thermal effects of wafer polishing using conventional polishing and polishing in accordance with the present invention.
Figure 9B:
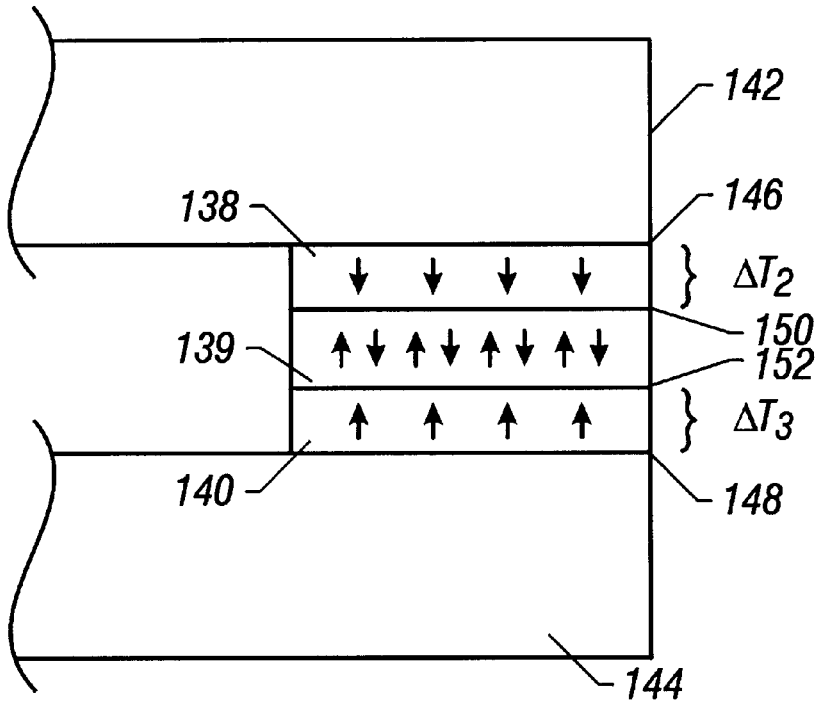

Referring now to FIGS. 9*a* and 9*b*, a greatly enlarged cross-sectional view of a pair of semiconductor wafer carriers is shown. FIG. 9*a* shows a conventional configuration where a wafer 126 mounted on a wafer carrier 130 is polished by a polishing pad 128 on one side only. Hence, heat will be generated due to friction at the point of contact between an upper surface 132 of the wafer 126 and the polishing pad 128. Heat will be conducted through the wafer 126 (designated by arrows) from the upper surface 132 to the opposite lower wafer surface 134 which is in contact with the carrier 130. Since heat is being applied to only one side of the wafer 130, and is conducted away from the wafer 126 by carrier 130, a heat gradient will exist between the upper wafer surface 132 and the lower wafer surface 134. This temperature gradient is designated as $\Delta T_1$ and is equal to the difference between the temperature of the upper surface 132 and the temperature of the lower surface 134 of the wafer 126.

In FIG. 9*b*, according to an embodiment of the present invention, a pair of wafers 138 and 140 mounted on upper and lower sides of a wafer carrier 139 are each polished simultaneously on a single side. In particular, an upper polishing pad 142 polishes an upper surface 146 of an upper wafer 138 and a lower polishing pad 144 polishes a lower surface 148 of a lower wafer 140. Heat will be generated by friction between the upper wafer 138 and the upper polishing pad 142 throughout the plane of contact on the upper surface 146 of the upper wafer 138. This heat flows downward toward the cooler carrier 139. Likewise, friction between the lower wafer 140 and the lower polishing pad 144 will generate heat on the lower surface 148 of the lower wafer 140 which flows upward toward the carrier 139.

Due to this bidirectional heat flow, the carrier 139 will be heated both from the top and the bottom. The carrier 139 will be at a higher temperature on its upper surface 150 where it contacts the upper wafer 138 than it would be without the presence of heat flow from the lower wafer 140. Likewise, the lower surface 152 of the carrier 139 will be at a higher temperature than it would be without the presence of heat flowing from the upper wafer 138. The temperature differential $\Delta T_2$ between the upper surface 146 of the upper wafer 138 and the upper surface 150 of the carrier 139 (which has the same temperature as the lower surface of the upper wafer 138) will be less than the temperature differential $\Delta T_1$ shown in FIG. 9*a*. Similarly, the temperature differential $\Delta T_3$ between the lower surface 148 of the lower wafer 140 and the lower surface 152 of the carrier 139 (which has the same temperature as the upper surface of the lower wafer 140) will be less than $\Delta T_1$.

Heat gradients in a semiconductor wafer can cause the wafer to deform thermally by bowing or warping, adversely affecting wafer flatness. Hence, it is likely that reduced thermal gradients in wafers using the techniques of the present invention contribute to the improved flatness resulting from the present invention.

Although only a few embodiments have been described in detail above, those having ordinary skill in the art should find that many modifications in the preferred embodiment are possible without departing from the teachings thereof. For example, the wafer polisher may employ various numbers of carriers, each having various numbers of wafers. Other techniques may be employed to induce movement of the carriers with respect to rotating polishing pads. Also, the thickness of wafer carriers may be modified to optimize various desired parameters. For example, the use of thicker carriers presents fewer material and mechanical problems than extremely thin carriers. Yet, somewhat thinner carriers may result in a reduction in thermal gradients which may improve flatness. Also, the present invention may be applied to other kinds of surfaces where a highly reflective and damage free surface is desired besides semiconductor wafers, for example, in the polishing of mirror surfaces.

All such modifications are intended to be encompassed within the following claims.

What is claimed is:

1. A wafer polishing apparatus comprising:

a carrier having top and bottom substantially parallel flat surfaces;

at least two generally flat wafers having first and second surfaces, one wafer removably attached on its second surface to the top surface of the carrier and the other wafer removably attached on its second surface to the bottom surface of the carrier;

two rotating turntables each having a flat polishing surface, one turntable disposed such that the flat polishing surface rotatingly contacts the first surface of the wafer attached to the top surface of the carrier, and the other turntable disposed such that the flat polishing surface rotatingly contacts the first surface of the wafer attached to the bottom surface of the carrier.

2. An apparatus as in claim 1 wherein one said wafer is attached to said carrier substantially vertically above another said wafer.

3. An apparatus as in claim 2 wherein said carrier is configured of materials and thickness such that frictional heat from contact between the rotating polishing surfaces and the wafers permits heat to be readily transferred from one wafer to the wafer on the opposite side of the carrier.

4. An apparatus as in claim 1 wherein said carrier is thicker than the wafers.

5. An apparatus as in claim 1 comprising a carrier drive mechanism operable to rotate said carrier about an axis.

6. An apparatus as in claim 5 wherein said drive mechanism is operable to rotate said carrier in a direction opposite to the rotational direction of the polishing surfaces.

7. An apparatus as in claim 5 further comprising a plurality of said carriers, wherein said carrier drive mechanism is operable to rotate a plurality of said carriers about a single axis.

8. An apparatus as in claim 7 wherein said drive mechanism also rotates each said carrier about that carrier's own central axis.

9. An apparatus as in claim 8 wherein said drive mechanism comprises:

carrier gear teeth along the outer circumference of the carrier;

a planetary gear; and a sun gear, wherein each said carrier is disposed symmetrically around the sun gear, the carrier gear teeth rotatably engaged with the planetary gear and the sun gear.

10. An apparatus according to claim 1 wherein said carrier has an annular shape.

11. An apparatus as in claim 1 further comprising polishing templates attached to both the top and bottom surfaces of the carrier, upon which said wafers are removably attached.

12. An apparatus as in claim 1 wherein said carrier has no holes that are approximately the diameter of said wafers.

13. A system for polishing semiconductor wafers comprising:

a pair of rotatable plate assemblies defining upper and lower polishing areas;

a drive mechanism configured to rotate each plate assembly;

a plurality of semiconductor wafers;

a carrier having top and bottom surfaces, said carrier supporting at least one semiconductor wafer on each surface, one side of the semiconductor wafer on top surface being in contact with the upper polishing area, and one side of the semiconductor wafer on bottom surface simultaneously being in contact with the lower polishing area; and a rotating mechanism for rotating said carrier about an axis.

14. A system according to claim 13 wherein said carrier is thicker than said semiconductor wafers.

15. A system according to claim 13 wherein said upper semiconductor wafer in contact with said upper polishing area is located substantially above said lower semiconductor wafer in contact with said lower polishing area.

* * * * *